US010304321B2

(12) United States Patent
Anderson et al.

(10) Patent No.: US 10,304,321 B2
(45) **Date of Patent: *May 28, 2019**

(54) SELF-CONFIGURING SENSING DEVICE

(71) Applicants: ECOLINK INTELLIGENT TECHNOLOGY, INC., Carlsbad, CA (US); PELLA CORPORATION, Pella, IA (US)

(72) Inventors: Howard Anderson, Pella, IA (US); Todd Bernhagen, Pella, IA (US); Andrew Permenter, Carlsbad, CA (US); Carlo Q. Petrucci, Carlsbad, CA (US)

(73) Assignee: ECOLINK INTELLIGENT TECHNOLOGY, INC., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/013,436

(22) Filed: Jun. 20, 2018

(65) Prior Publication Data

US 2018/0301021 A1 Oct. 18, 2018

Related U.S. Application Data

(63) Continuation of application No. 15/041,568, filed on Feb. 11, 2016, now Pat. No. 10,008,106.

(51) Int. Cl.

| | |
|---|---|
| ***G08B 29/24*** | (2006.01) |
| ***G08B 13/08*** | (2006.01) |
| ***G08B 29/20*** | (2006.01) |

(52) U.S. Cl.

CPC ..... *G08B 29/24* (2013.01); *G08B 13/08* (2013.01); *G08B 29/20* (2013.01)

(58) Field of Classification Search

None

See application file for complete search history.

(56) References Cited

U.S. PATENT DOCUMENTS 4,763,937 A * 8/1988 Sittnick, Jr. ..... E05B 49/00 292/251.5

6,196,037 B1 3/2001 Urschel et al.

(Continued)

OTHER PUBLICATIONS

ISA/US, International Search Report and Written Opinion issued on PCT application No. US17/17206, dated Apr. 17, 2017, 10 pages.

*Primary Examiner* — John F Mortell

(74) *Attorney, Agent, or Firm* — Greenberg Traurig, LLP

(57) ABSTRACT

A self-configuring sensor and method of operation of the sensor is described. In one embodiment, the self-configuring sensor comprises a first sub-sensor for determining a first status of a door or window, a second sub-sensor for determining a second status of the door or window, a wireless transmitter, a memory for storing processor-executable instructions, and a processor coupled to the first sub-sensor, the second sub-sensor, the wireless transmitter and the memory for executing the processor-executable instructions that cause the sensor to monitor the first and second sub-sensors for detecting changes in a first sub-sensor state and a second sub-sensor state, respectively, and determine an installation configuration based on the changes in the first sub-sensor state and the second sub-sensor state, the installation configuration comprising a type of hardware where the self-configuring sensor has been installed.

20 Claims, 9 Drawing Sheets

(56) References Cited

U.S. PATENT DOCUMENTS

| | | | | |
|---|---|---|---|---|
| 6,963,280 | B2 | 11/2005 | Eskildsen | |
| 7,086,257 | B2 | 8/2006 | Bucket et al. | |
| 2005/0044908 | A1 | 3/2005 | Min | |
| 2007/0139183 | A1 | 6/2007 | Kates | |
| 2008/0018438 | A1* | 1/2008 | Ehrlich | G07C 11/00 340/431 |
| 2008/0084299 | A1 | 4/2008 | Fisher et al. | |
| 2009/0300988 | A1 | 12/2009 | Bem | |
| 2010/0152947 | A1 | 6/2010 | Denholm et al. | |
| 2011/0016971 | A1* | 1/2011 | Yulkowski | G08B 21/043 73/493 |

* cited by examiner

SELF-CONFIGURING SENSING DEVICE

CROSS-REFERENCE TO RELATED APPLICATIONS

This application is a continuation of U.S. patent application Ser. No. 15/041,568, filed on Feb. 11, 2016.

BACKGROUND

I. Field of Use

The present application relates generally to the field of sensing devices. More specifically, the present application relates to a self-configuring sensing device, typically used in home security systems.

II. Description of the Related Art

Home security systems have been available for many years, and have been growing in popularity recently. These systems typically employ a number of door/window sensors to monitor the open/closed state of doors and windows, as well as other sensors, such as motion sensors, sound detectors, tilt sensors, etc.

Wired door/window sensors have been in existence for over thirty years, typically a magnet and reed switch combination, the reed switch comprising an electrical contact or switch that opens and closes upon application/removal of a magnetic field. More recently, these sensors have incorporated RF circuitry to transmit wireless signals to a central controller located on a premises being monitored. The magnet is typically installed onto a movable part of a window or door, while the reed switch assembly is mounted to a stationary surface, such as a door or window frame. When the door or window is closed, the magnet and reed switch are in close proximity to one another, maintaining the reed switch in a first state indicative of a "no alarm" condition. If the door or window is opened, proximity is lost between the magnet and the reed switch, resulting in the reed switch changing state, e.g., from closed to open or from open to closed. When this occurs, it indicates that the door or window has been opened and, in response, the sensor sends a signal to the central controller in the home, which may send an alarm signal to a remote monitoring facility or sound a loud, audible alert.

One disadvantage of typical door/window sensors is that a variety of different types are typically needed to match particular types of different windows or doors. For example, a home may have a number of double-hung windows, requiring sensors of a first type, while also having a number of casement windows, requiring sensors of a different type. Thus, professional installers must ensure that they carry enough of each type of sensor when they install new systems, thus increasing their inventory requirements, which costs money, takes up space, etc. When a sensor fails, a technician must likewise ensure that both types of sensors are available in inventory, as there is no way of knowing which type of sensor might be installed.

Thus, it would be desirable to provide security sensors that allow installers and repair professionals to minimize their inventory and to have more information pertaining to sensors that have failed.

SUMMARY

The embodiments described herein relate to methods, systems, and apparatus of a sensor able to determine an installation configuration after it has been installed into a door or a window. In one embodiment, a self-configuring sensor is described, comprising a first sub-sensor for determining a first status of a door or window, a second sub-sensor for determining a second status of the door or window, a wireless transmitter, a memory for storing processor-executable instructions, and a processor coupled to the first sub-sensor, the second sub-sensor, the wireless transmitter and the memory for executing the processor-executable instructions that cause the sensor to monitor the first and second sub-sensors for detecting changes in a first sub-sensor state and a second sub-sensor state, respectively, and determine an installation configuration based on the changes in the first sub-sensor state and the second sub-sensor state, the installation configuration comprising a type of hardware where the self-configuring sensor has been installed.

In another embodiment, a method is described, performed by a self-configuring sensor, comprising monitoring, by a processor, a first sub-sensor and a second sub-sensor for changes in a first sub-sensor state and a second sub-sensor state, respectively, and determining, by the processor, the installation configuration based on the changes in the first sub-sensor state and the second sub-sensor state, the installation configuration comprising a type of hardware where the self-configuring sensor has been installed.

BRIEF DESCRIPTION OF THE DRAWINGS

The features, advantages, and objects of the present invention will become more apparent from the detailed description as set forth below, when taken in conjunction with the drawings in which like referenced characters identify correspondingly throughout, and wherein.

DETAILED DESCRIPTION

The present description relates to an electronic sensor capable of automatically determining its installation configuration, e.g., a type of hardware, such as a door or a window, where the sensor has been installed. For example, in the home security industry, a single sensor type may be used to monitor a variety of doors and windows to detect door and window status, such as open/closed or locked/unlocked, and use that information to determine a type of window or door that it is installed in. The status of a door or window may be determined based on input from two or more sub-sensors that either reside within the sensor, or are connected to the sensor via wires or some other input. For example, a sensor may comprise two internal sub-sensors, a reed switch and a mechanical plunger switch. After such a sensor is installed into a single-hung sliding window, for example, the sensor may automatically determine that it is, in fact, installed into a single-hung window by noting that only its reed switch changes state.

Figure 1:
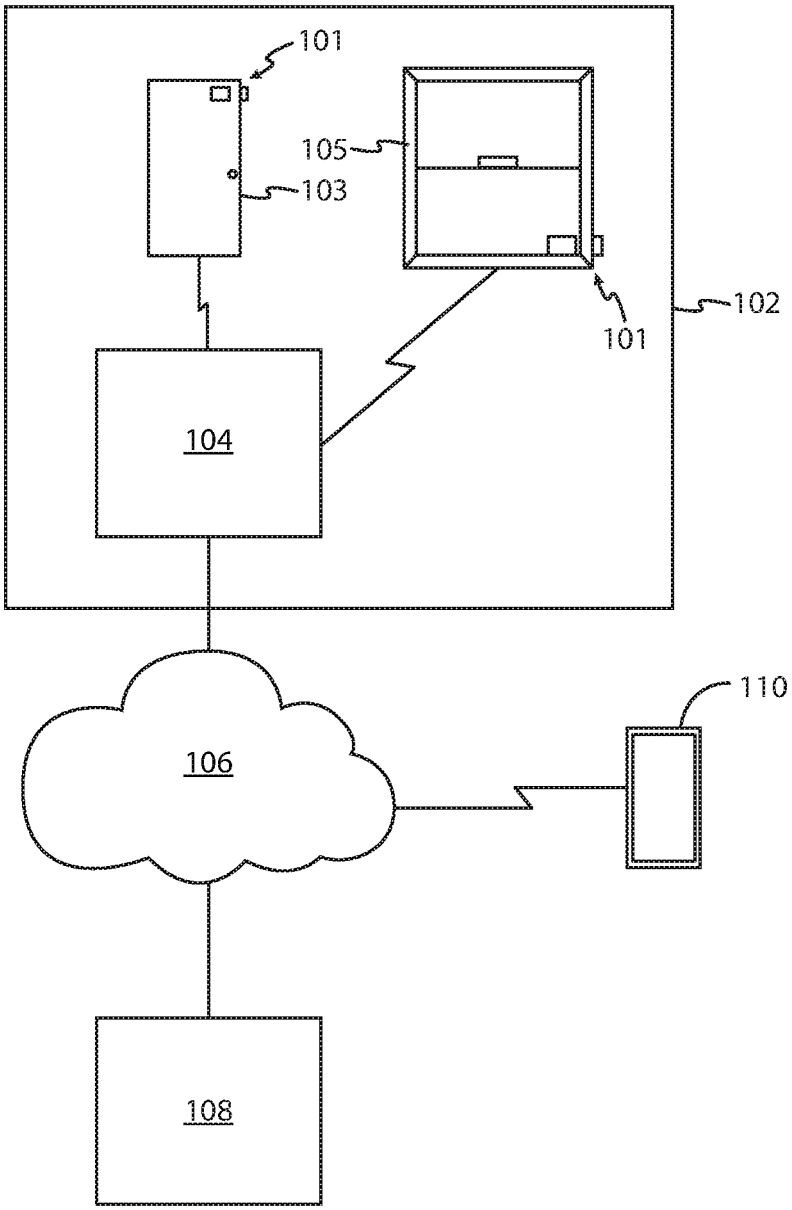
FIG. 1 is a block diagram of one embodiment of a security system where self-configuring sensors monitor a door and a window status in accordance with the teachings herein.

FIG. 1 is a block diagram of one embodiment of a security system where self-configuring sensors 101 monitor door 103 and window 105 status in accordance with the teachings herein. Shown are sensors 100 mounted to a variety of doors and windows in a residence 102, gateway 104, wide-area network 106, server 108, and remote device 110. The sensors 101 communicate wirelessly with gateway 104 when a change in door or window status is detected, i.e., a door or window has opened and/or has become unlocked. Gateway 104, in turn, provides a notification to server 108 via wide-area network 106, that a change in status has occurred, and server 108 may notify a person associated with residence 102, such as a homeowner, via wide-area network 106 and remote device 110.

Each of the sensors 101 comprise two or more sub-sensors, either internally and/or connected to the sensors 101, as will be discussed in greater detail below. The sensors 101 monitor doors and windows to determine state changes such as door and window open/closed and/or locked/unlocked status. When a change in status occurs, the sensors 101 transmit wireless signals to gateway 104, using conventional wireless communication techniques well known in the art.

The status signals from sensors 101 are received by gateway 104, which comprises a wireless receiver for receiving the status signals, a memory for storing information related to the sensors 101, and a network interface for communicating with server 108 via wide-area network 106. Wide-area network 106 comprises one or more wired or wireless data networks, including the Internet, local-area networks, cellular networks, satellite networks, etc.

Figure 2:
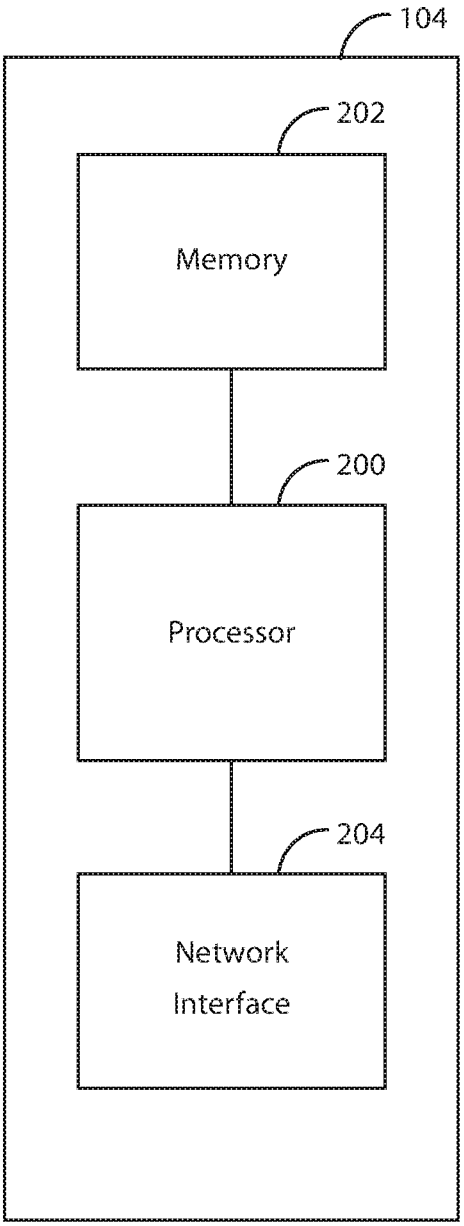
FIG. 2 is a functional block diagram of one embodiment of the server shown in FIG. 1.

FIG. 2 is a functional block diagram of one embodiment of server 108, comprising processor 105, memory 202, and network interface 204. Processor 105 is configured to provide general operation of sever 108 by executing processor-executable instructions stored in memory 202, for example, executable code. Processor 105 is typically a general purpose microprocessor or microcontroller, such as any one of a number of microprocessors manufactured by Intel Corporation of Santa Clara, Calif. Processor 105 receives status signals from sensors 101 and provides notifications to a user of remote device 110 when a change in status occurs.

Memory 202 comprises one or more information storage devices, such as RAM, ROM, EEPROM, UVPROM, flash memory, SD memory, XD memory, or virtually any other type of electronic memory device. Memory 202 is used to store the processor-executable instructions for operation of server 108 as well as information provided by sensors 101 and user account information associated with gateway 104 and the sensors 101. Memory 202 is also used to store installation configuration description information, as will be described in greater detail below. Memory 202 may also be used to store web site information to allow users of gateway 104 to register with server 108, to monitor sensors 101, and to receive information pertinent to the sensors 101, such as a historical record of dates and times that state changes have been detected.

Network interface 204 comprises circuitry necessary for processor 105 to communicate with gateway 104, as well as remote devices, such as remote device 110 using techniques well-known in the art.

Remote device 110 comprises a smart phone, personal computer, tablet, or other personal computing device able to communicate with server 108 via wide-area network 106. Remote device 110 may execute a software application or "app", downloaded from an software application repository, such as Apple Incorporated's "App Store" or Google Incorporated's "Google Play Store", that allows a user of remote device 110 to receive notifications from gateway 104 when a change in door/window status is detected and, generally, to monitor the status of sensors 101 and, hence, the status of door 103 and window 105. Alternatively, remote device 110 is capable of presenting web pages to a user, such as a website provided by server 108, in order for the user to manage gateway 104 and the sensors 101, and to receive information pertinent to gateway 101 and the sensors 101.

Figure 3:
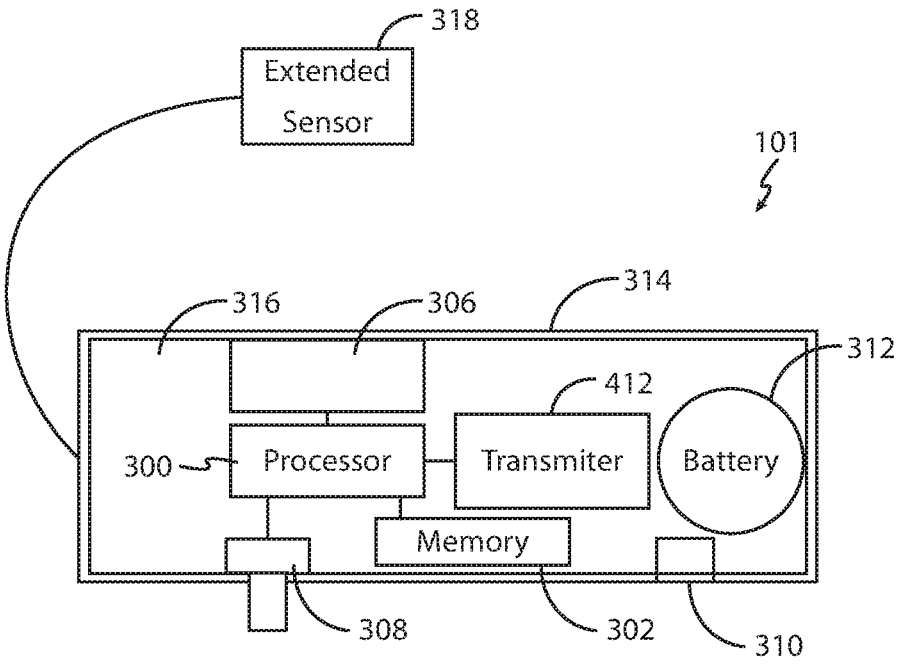
FIG. 3 is a plan view of one embodiment of one of the sensors shown in FIG. 1, shown without a cover.

FIG. 3 is a plan view of one embodiment of sensor 101, shown without a cover that is normally used to conceal the components that comprise sensor 101. The components of sensor 101, in this embodiment, comprise processor 300, memory 302, transmitter 304, first sub-sensor 306, second sub-sensor 308, port 310, battery 312, housing 314, circuitry board 316, and external sensor 318. Processor 300 is coupled to first sub-sensor 306, second sub-sensor 308, and port 310 to determine the installation configuration of sensor 101, i.e., whether sensor 101 is installed into a door or a window, and/or a type of door or window that sensor 101 is installed.

The sensor 101 is capable of being installed onto or into several different types of doors and windows, due to the number and positioning of the sub-sensors, as will be explained in further detail below. Each of the sub-sensors is used to detect a state or status, or a change in the state or status, of a door or window, wherein a state or status of a door or window may comprise "open", "closed", "locked", "unlocked", "closed and locked", "open and locked", "closed and unlocked" and "open and unlocked".

The processor, memory transmitter, port and sub-sensors are typically mounted on circuit board 316. Battery 312 typically comprises a "coin cell" battery due to the size constraints typical of sensor 101 and may be held in place to circuit board 316 via retaining clips or other mechanical means. Battery 312 is used to provide a DC voltage to the components. It should be understood that in other embodiments, a fewer or a greater number of sub-sensors and/or ports may be used. It should also be understood that while the present description describes sensor 101 as a door/window sensor for use in home security applications, sensor 101 could be used in other applications other than home security, such as in industrial applications.

Processor 300 provides general operation of sensor 101, for detecting state or status changes in a door or window, for transmitting an alarm signal to a nearby gateway 104, for determining an installation configuration of sensor 101, and for taking one or more actions based on the determination. Processor 300 performs these functions by executing processor-executable code stored in memory 302, for example, executable code. Processor 300 typically comprises a general purpose processor, such as an ADuC7024 analog microcontroller manufactured by Analog Devices, Inc. of Norwood Mass., although any one of a variety of microprocessors, microcomputers, and/or microcontrollers may be used alternatively, selected to meet the requirements of a small, battery-powered sensor such as low power usage and small size.

Memory 302 comprises one or more information storage devices, such as RAM, flash memory, SD memory, XD memory, or other type of electronic, optical, or mechanical memory device. Memory 302 is used to store the processor-executable instructions that cause sensor 101 to perform its functions as listed above. Memory 302 may additionally store certain operational information, such as a serial number, node number or house code (assigned by the gateway 104, in one embodiment), one or more predetermined time thresholds, and/or current or previous door or window status information.

Sub-sensor 306, in this embodiment, comprises a reed switch mounted to circuit board 316, positioned at a top edge of circuit board 316 for use in configurations of sensor 101 that utilizes a magnet for detecting a status of a door or window, for example, whether a door or window is open or closed. In other embodiments, a magnetoresistive sensor could be used in place of the reed switch, which also detects the presence of magnetic fields.

Sub-sensor 308 in this embodiment comprises a mechanical switch activated by, for example, a mechanical plunger, lever, pushbutton or other mechanical device, wherein the switch is opened and closed as a door or window, or components thereof, are opened, closed, locked, and/or unlocked.

External sub-sensor 318 in this embodiment comprises a second mechanical switch and can be the same switch type as sub-sensor 306 or a different mechanical type. External sub-sensor 318 can be used to detect changes in a door or window status by detecting changes in a door or window position, a lever position, a deadbolt position, a door or window handle position, cam, shaft, or some other mechanical component of a door or window. External sub-sensor 318 is typically used to provide signals to processor 300 where positioning of sensor 101 is prohibitive, such as in a very confined area, such as within a doorknob or deadbolt assembly.

It should be understood that in other embodiments, sensor 101 may comprise different types and/or a different number of sub-sensors, including additional external sub-sensors or even no external sub-sensor at all. It should also be understood that some or all of the sub-sensors may comprise sensing devices other than reed switches, magnetoresistive sensors, or mechanical switches, such as photo-sensitive components such as photo-diodes and transistors, IR sensors, shock sensors, glass breakage detectors, accelerometers, vibration sensors, conductivity sensors, etc.

The sub-sensors are each coupled to processor 300 to provide signals that enable processor 300 to determine a state or status of each sub-sensor and, hence, a particular door or window status or state. Processor 300 uses the state or status information to determine an installation configuration of sensor 101, as will be explained below.

Figure 4:
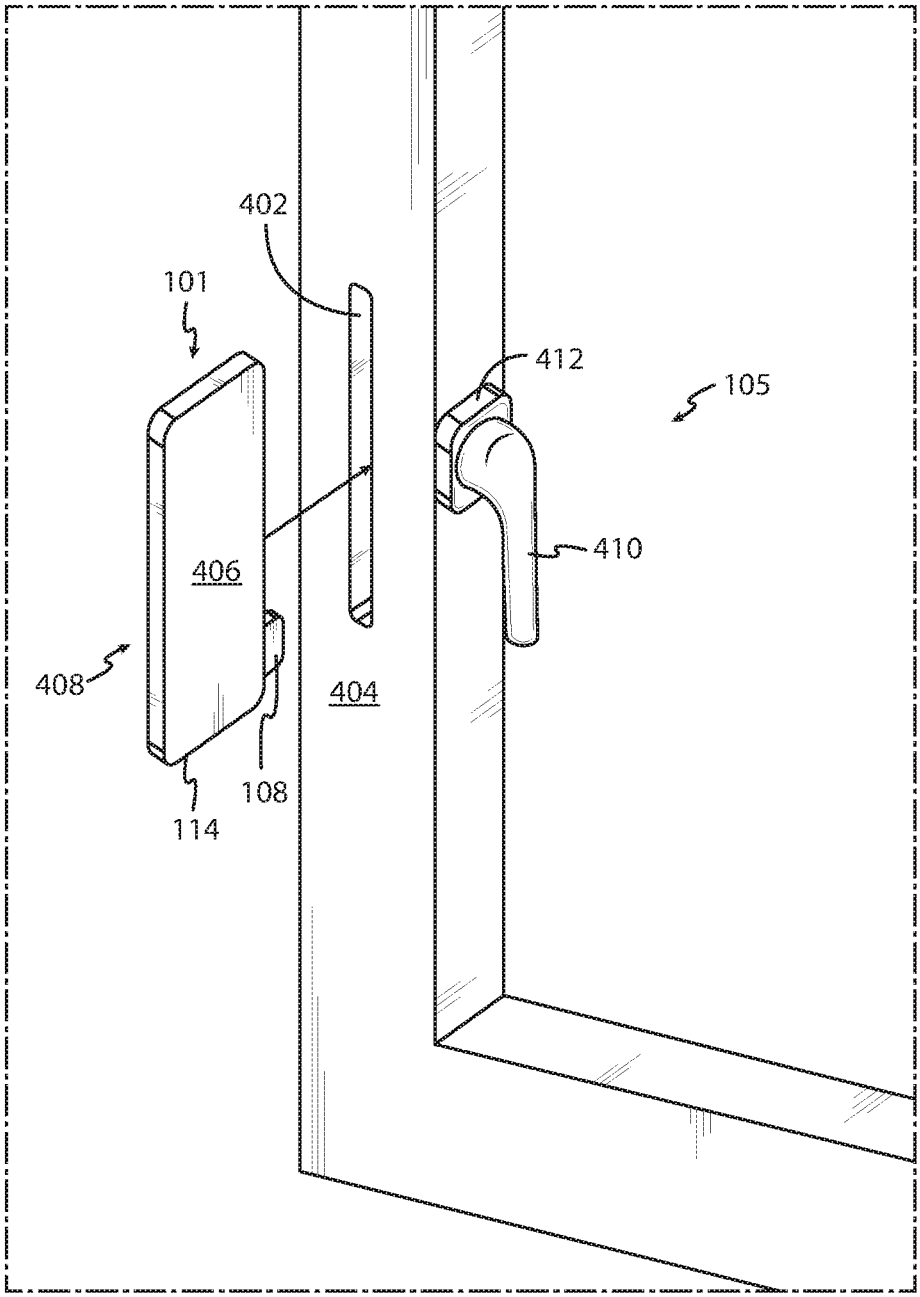
FIG. 4 is an illustration of the sensor shown in FIGS. 1 and 3 installed into a casement window, used to monitor both an open/close status and a locked/unlocked status of the window.

FIG. 4 is an illustration of the self-configuring sensor 101 shown of FIGS. 1 and 3 in a casement window installation configuration, used to monitor both an open/close status of window 105 as well as a locked/unlocked status of window 105. Sensor 101 is shown about to be inserted into slot 402 formed in stationary, side jamb 404. Slot 402 is sized and shaped to accommodate the size and shape of sensor 101 and may comprise retaining means (not shown) for retaining sensor 101 within slot 402 after installation of sensor 101 into slot 402. In this embodiment, sub-sensor 306 and 308 are used, while external sensor 318 and port 310 are not used.

Installation of sensor 101 comprises removing cover 406 from housing 314 and inserting battery 312 into its designated retaining means on circuitry board 316. Then, cover 406 is secured back onto housing 314, and sensor 101 is pushed into slot 402, where it is retained by the aforementioned retaining means. A magnet (not shown) is secured to the movable portion 404 of window 105 such that it is proximate to sensor 101 when the movable portion 404 of window 105 is in a closed state.

Sub-sensor 306 in this embodiment comprises a reed switch mounted to circuit board 316, positioned at an edge of circuit board 316 for use in configurations of sensor 101 that utilize a magnet for detecting a status of a door or window, for example, whether a door or window is open or closed. Sub-sensor 306 is positioned inside of sensor 101 near area 208, as shown. When sub-sensor 306 inside sensor 101 comes in close proximity to the magnet when window 105 is closed, sub-sensor 306 changes state due to the presence of an magnetic field produced by the magnet, for example, from open to closed. Processor 300 detects when a change in state of sensor 306 occurs. When window 105 is opened, the magnet becomes separated from sensor 306, thus causing a contact within sub-sensor 306 to change state once again, and processor 300 detects the change.

To lock and unlock window 105, handle 410 is used by an operator to rotate pin 412, which rotates a latch (not shown) that engages a keeper (also not shown) on the vertical frame of movable portion 204 of window 105. The positioning of sub-sensor 108 on sensor 101, the positioning of sensor 101 within slot 402, and the position of the latch causes the latch to physically act upon sub-sensor 308 as handle 410 is being operated, causing, for example, a plunger of sub-sensor 308 to be pushed by the latch, causing a contact within sub-sensor 308 to change state. Thus, when the plunger of sub-sensor 308 is pushed in by the latch, processor 300 determines that window 105 is locked, and when the plunger is not pushed in by the latch, processor 300 determines that window 105 is unlocked.

Figure 5:
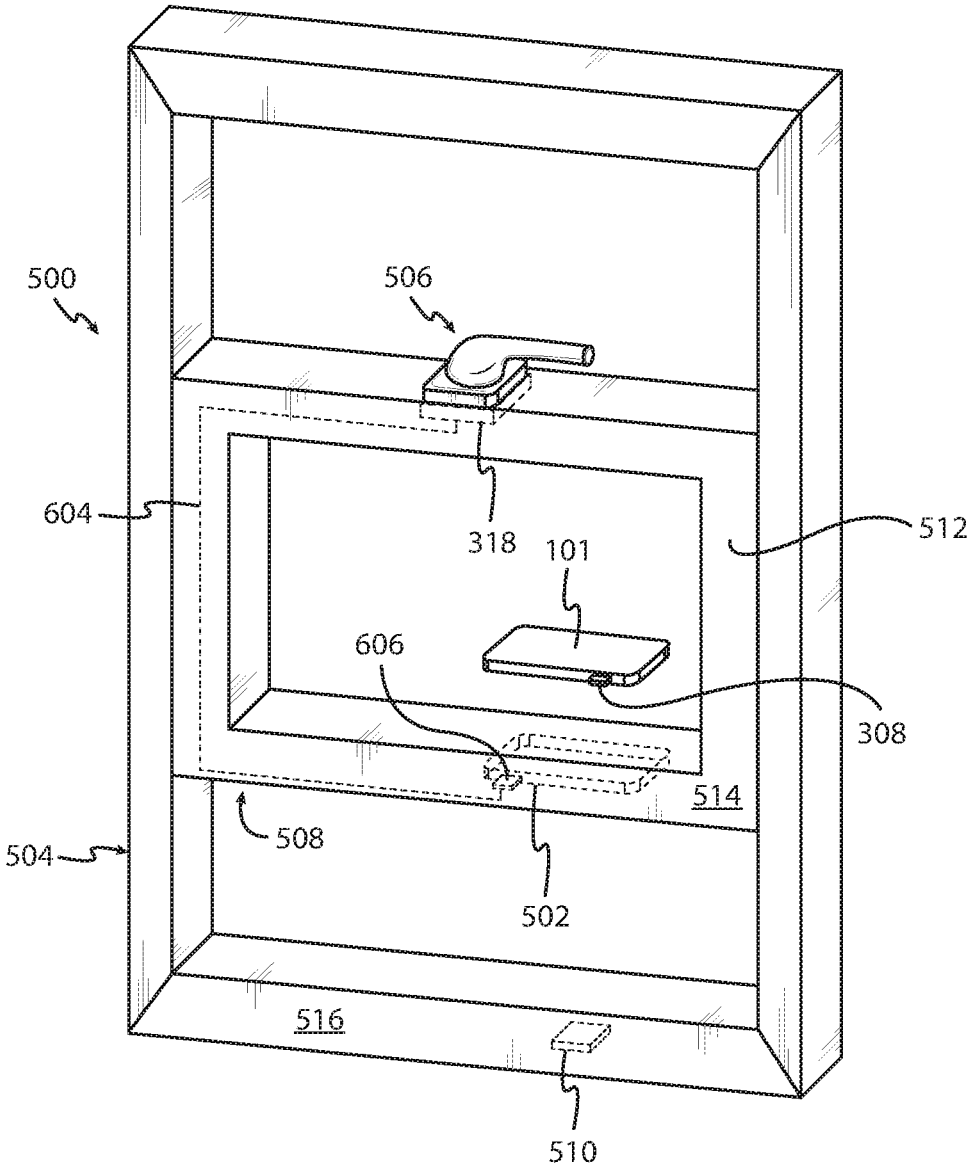
FIG. 5 is an illustration of one embodiment of the sensor shown in FIGS. 1 an 3 installed into a single or double hung window.

FIG. 5 is an illustration of one embodiment of the sensor of FIG. 1 used in a single or double hung window installation configuration. Shown is single hung window 500 comprising jamb 504 and movable panel 512. A stationary panel (single hung embodiment) or a second movable panel (double hung embodiment) is not shown for purposes of clarity.

Formed into a lower horizontal edge 514 of movable panel 512 is slot 502, where sensor 101 is inserted into during use. It should be understood that slot 502 could be located in different areas of movable panel 512, or even located on a fixed portion of window 500, such as jamb 504.

In FIG. 5, sensor 101 is shown having a plunger of sub-sensor 308 protruding therefrom, just prior to insertion into slot 502. In this embodiment, sub-sensor 306 within sensor 101 and external sub-sensor 318 located on, within or near lock/unlock mechanism 506 as shown, are used to detect the open/close status and lock/unlock status, respectively, of window 500. In this embodiment, sensor 101 comprises the same sub-sensors as shown in FIGS. 1 and 2, with sub-sensor 306 comprising a reed switch, sub-sensor 108 comprising a plunger-type, mechanical switch, and external sub-sensor 318 comprising a mechanical switch.

With regard to sub-sensor 306, once sensor 101 is installed into slot 502, sub-sensor 306 detects a magnetic field produced by magnet 510 when movable panel 512 is placed into the closed position. Magnet 510 may be embedded into lower jamb 516 (as shown) or attached to a surface of lower jamb 516 in other embodiments.

Figure 6A:
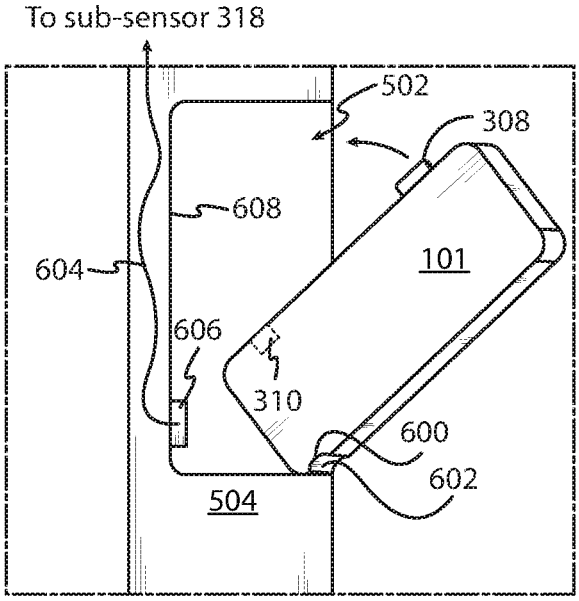
FIGS. 6*a* and 6*b* illustrate a close-up, top, plan, cutaway view of a slot formed into a window frame, with the sensor of FIGS. 1 and 3 about to be installed into the slot.
Figure 6B:
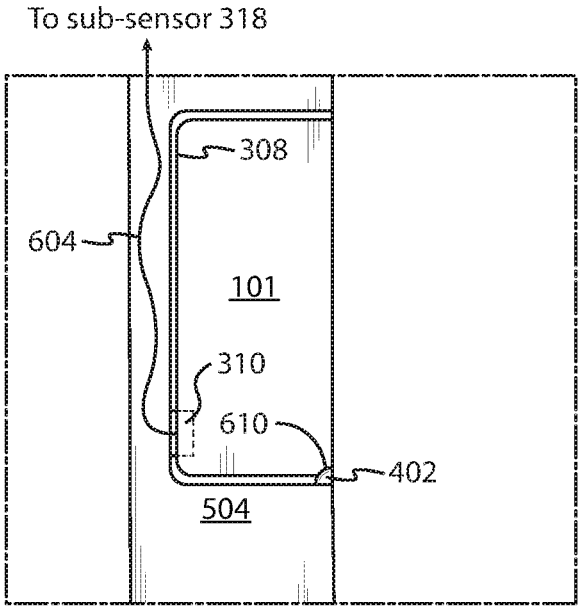

As sensor 101 is placed into slot 502 during initial installation, a physical connection is made between port 310 and a connector located inside slot 502, best shown in FIGS. 6*a* and 6*b*. FIG. 6*a* illustrates a close-up, top, plan cutaway view of slot 502 and sensor 101 as sensor 101 is just about to be installed into slot 502. In this embodiment, sensor 101 comprises a convex cutout in housing 314 for rotatable engagement with knob 602 formed inside slot 502 as shown. Once convex cutout 600 is engaged with knob 602, sensor 101 may be rotated about an axis of knob 602 and pressing sensor 101 fully into slot 502, as shown in FIG. 6*b*. Slot 502 comprises connector 606 located on a rear wall of slot 502, such that it connects to port 310 when sensor 101 is seating into slot 502. As shown in FIG. 6*b*, connector 606 is connected to port 310, thus enabling signals from an external sub-sensor (not shown) to be provided to sensor 101 via wire 604. The sub-sensor in this example may comprise a mechanical switch located near/within lock/unlock assembly 506 to provide signals to sensor 101 when the lock/unlock assembly is moved from a locked position to an unlocked position and vice-versa.

It should also be pointed out that a plunger of sub-sensor 308 is pushed into sub-sensor 308 as sensor 101 is seated into slot 502 by rear wall 608. This forces sub-sensor 108 into a single state, either open or closed depending on sub-sensor 308. The fact that sub-sensor remains in a single state (e.g., open or closed) during operation may be used to define an installation configuration of sensor 101, as will be explained later. In an alternative embodiment, rear wall 608 comprises an cavity located to receive the plunger of sub-sensor 308 such that it is not pushed into sub-sensor 308, thereby maintaining a contact within sub-sensor 308 in a state opposite to a pushed-in state.

The concepts taught be FIGS. 5, 6*a*, and 6*b* can be applied to other installation configurations. For example, for a sliding patio door, the same slot 402, 502 can be formed into a side jamb of the door, with a magnet installed into the sliding portion, proximate to sub-sensor 306 when the door is closed and also using port 310 and external sub-sensor 318 in the form of a mechanical or magnetic switch to detect the lock/unlock status of the door. Similar to the discussion above with respect to FIGS. 6*a* and 6*b*, the rear wall of the slot in other embodiments may or may not have an indentation to force a mechanical switch into one state or another, thereby providing additional information to processor 300 in order to determine its installation configuration.

Figure 7A:
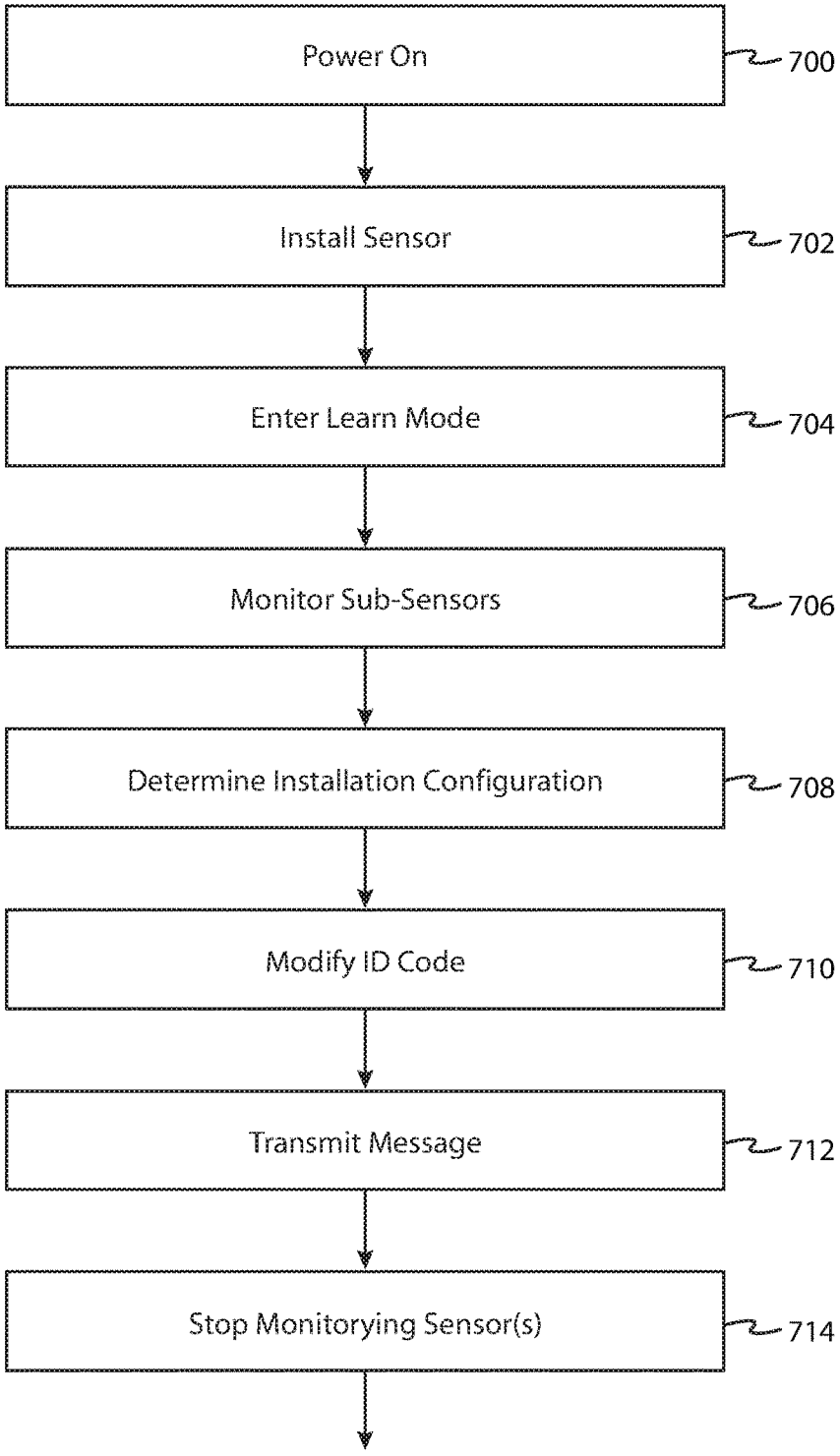
FIGS. 7*a* and 7*b* are flow diagrams illustrating one embodiment of a method for determining an installation configuration of a sensor, performed by the sensor shown in FIGS. 1 and 3.
Figure 7B:
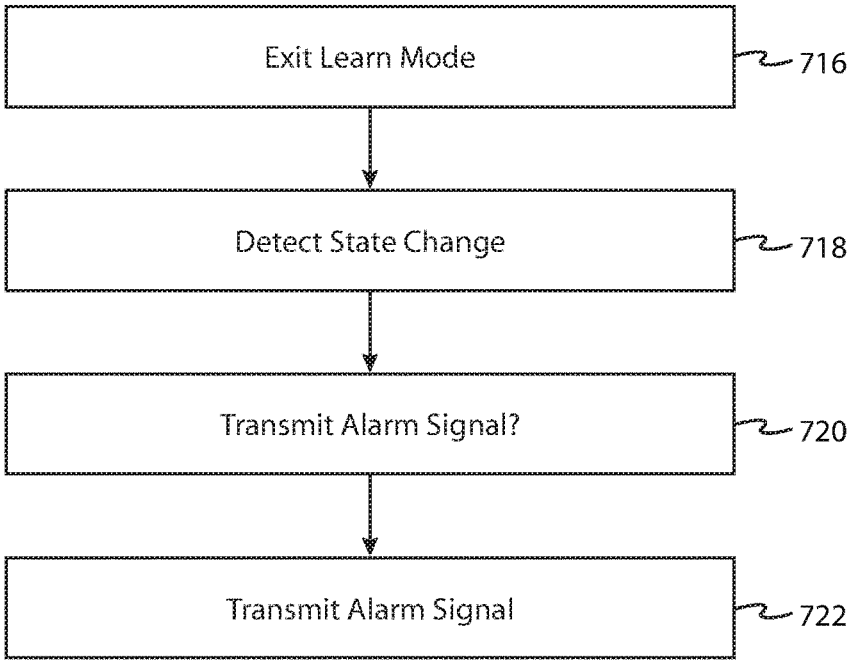

FIG. 7 is a flow diagram illustrating one embodiment of a method for determining an installation configuration of a sensor, performed by sensor 101. It should be understood that in some embodiments, not all of the steps shown in FIG. 7 are performed, that the order in which the steps are carried out may be different in other embodiments, and that certain, minor steps have been omitted for brevity.

At block 700, sensor 101 is powered on by a user, such as a homeowner or professional installer, by removing a cover 406 from housing 314 and installing a battery 312 inside sensor 101. Alternative methods of powering sensor 101 on include removing a non-conductive barrier between an already-installed battery inside sensor 101 and a battery contact.

At block 702, sensor 101 is installed into a door or a window, by pushing sensor 101 into a pre-formed slot in a door or window sill, jamb or other door or window portion. The slot is sized and shaped to receive sensor 101.

At block 704, in one embodiment, in response to being powered on, processor 300 executes processor-executable instructions stored in memory and causes sensor 101 to enter into a learn mode of operation. The learn mode of operation allows sensor 101 to determine an installation configuration of sensor 101 and typically disables normal operations of sensor 101 to transmit state change signals to gateway 104.

In another embodiment, sensor 101 is capable of self-determining its installation configuration without having to enter into a learn mode of operation. In this embodiment, the installation configuration may be determined while sensor 101 is operating normally, i.e., monitoring a door or window for status changes, and transmitting an alarm signal to gateway 104 is a change in state of one or more sub-sensors is detected. For example, sensor 101 could be configured to determine the time between when one or more sub-sensors changes state, and/or the number of times that a sub-sensor changes state within a predetermined time period, such as three seconds. For example, after being installed into a door or a window, a homeowner or an installer may lock and unlock a locking mechanism on the door or window, causing an associated sub-sensor to change states multiple times within a relatively short time interval. When a sub-sensor changes state very quickly (e.g., from locked to unlock to locked) very quickly, such as within one second, it is an indication to processor 300 that the lock is being exercised for purposes of determining the sensor's installation configuration and, therefore, no alarm signal is transmitted, and processor 300 stores an indication in memory 202 that the sub-sensor that changed state during this time is an active sub-sensor, able to change state in its current installation configuration. Alternatively, when processor 300 detects that a sub-sensor has changed state a predetermined number of times with a short time interval, such as three seconds, it may also be an indication to processor 300 that the lock is being exercised for purposes of determining the sensor's installation configuration and, again, no alarm signal is transmitted. At this point, processor 300 does not have enough information to know what its installation configuration might be, because a determination requires information from a second sub-sensor. When processor 300 determines that a second sub-sensor has changed state as explained above with respect to the first sub-sensor, processor 300 may determine its installation configuration, as described below.

At block 706, processor 300 monitors sub-sensors 306 and 308, as well as port 310, to determine whether any sub-sensor changes state. One or more contacts of the sub-sensors will change state when a door or window status changes, e.g., a door or window is opened or closed, or a door or window becoming locked or unlocked. Processor 300 typically remains in the learn mode of operation for a predetermined time period, such as one minute, as stored by memory 302. The user may be instructed to open and close the door or window and also lock and unlock the door or window in order to "exercise" any sub-sensor that may be monitoring the open/close status or the lock/unlock status of the door or window. The user may be instructed to operate the door or window in this manner immediately after powering on sensor 101 and installing it into the door or window, and continue to do so for a predetermined time period, such as thirty seconds or one minute. This allows processor 300 enough time to evaluate signals caused by the sub-sensors changing state as a result of detecting operation of the door or window by the user.

At block 708, processor 300 determines an installation configuration of sensor 101, e.g., a type of door or window that sensor 101 has been installed into. Processor 300 determines the installation configuration by evaluating any changes (or lack thereof) observed in the sub-sensors, including external sub-sensor 318, if present.

For example, when processor 300 determines that sub-sensor 306 has changed state during learn mode ("toggled") at least once and that sub-sensor 306 has also changed state at least once during the learn mode, processor 300 compares this result with results stored in memory 302. Memory 302 stores mapping information, in one embodiment in the form of a look-up table, that allows processor 300 to determine the installation configuration based on the sub-sensor input during the learn mode, as shown:

| Installation Config | Sub-sensor 306 | Sub-sensor 308 | Ext. Sub-Sensor 318 | Open/Close Sensor |
|---|---|---|---|---|
| Casement Window | Toggled | Toggled | Open | Sub-sensor 306 |
| Single/Double Hung Window | Toggled | Open | Toggled | Sub-sensor 306 |
| Sliding Patio Door | Toggled | Closed | Toggled | Sub-sensor 308 |
| Hinged Door | Open | Toggled | Toggled | Sub-sensor 308 |

Thus, when processor 300 has determined that sub-sensor 306 and sub-sensor 108 were toggled during the learn mode, it determines that sensor 101 has been installed into a window, and more particularly a casement window, per the information stored in memory 302. In this example, the state of external sub-sensor 318 is immaterial. When processor 300 determines that sub-sensor 306 and external sub-sensor 318 were toggled, while sub-sensor 308 remained in an open state, processor 300 determines that sensor 101 has been installed into a single or double hung window. Sub-sensor 308, e.g., a mechanical plunger switch, could remain open (plunger extended) if the slot into which sensor 101 is placed comprises a cavity in its rear wall that accommodates the plunger, so that it does not change state when sensor 101 is installed into the slot. Conversely, sub-sensor 308 could remain in a closed state (i.e., plunger retracted) if the slot into which sensor 101 is placed comprises a protrusion on its rear wall at a location that engages sub-sensor 308 when sensor 101 is installed into the slot.

At block 710, after the installation configuration has been determined by processor 300, processor 300 modifies a sensor identification code stored in memory 302 in accordance with the determined installation configuration. For example, sensor 101 could be assigned an 18-bit serial number during manufacturing, with 16 of the bits reserved as a unique serial number to identify the particular sensor, while 2 bits could be reserved to identify the sensor configuration installation. For example, during the manufacturing stage, the first 16 bits of an 18 bit identification code could comprise be assigned a unique 16 bit serial number, followed by a default installation configuration code of two zeros, which may correspond to the most common installation configuration that sensor 101 is installed. In this way, processor 300 does not need to alter the identification code if processor 300 determines that sensor 101 has been installed into this most-common installation configuration. In this example, the last two bits that have been assigned 00 may uniquely define four installation configurations. Increasing this number to three bits obviously allows eight installation configurations to be defined. A greater number of installation configurations could be designated by increasing the number of installation configuration bits.

At block 712, in response to changing the identification code, processor 300 may transmit a message to a gateway 104 to inform gateway 104 of sensor 101's current installation configuration.

At block 714, processor 300 may cease monitoring one or more sub-sensors as a result of knowing which sub-sensors are "active" in the present installation configuration. For example, if the installation configuration was determined to be a sliding patio door, where sub-sensors 306 and 318 are active, while sub-sensor 308 was determined to be "static". In this case, processor 300 may stop monitoring sub-sensor 308, and/or disable sub-sensor 308 (such as de-energizing circuitry necessary for the operation of sub-sensor 308) knowing that in the current installation configuration, sub-sensor 308 does not change state. This feature may increase battery life by reducing overall power consumption by sensor 101.

At block 716, processor 300 may cause sensor 101 to exit the learn mode of operation.

At block 718, processor 300 may detect a status change of one or more sub-sensors, indicating a status change of a respective door or window being monitored by a respective one of the sub-sensors.

At block 720, processor 300 determines whether or not to transmit an alarm signal to gateway 104, based on the installation configuration. For example, sensor 101 may be configured to transmit an alarm signal only when a door or window opens, and not transmit an alarm signal if a door or window merely becomes unlocked. The installation configuration further comprises an identification of which sub-sensor is associated with monitoring the open/close status of a door or window for each door or window type. For example, in a casement window, sub-sensor 308 is used to determine the open/close status of a casement door, while for a sliding patio door, the open/close status of the door is determined by sub-sensor 308. Knowing the type of door or window that sensor 101 has been installed allows processor 300 to determine whether to transmit an alarm signal.

At block 722, when processor 300 determines that a sub-sensor relating to an open/closed status of a door or window changes state, processor 300 causes transmitter 304 to transmit an alarm signal to gateway 104. The alarm signal typically comprises at least the identification code.

Figure 8:
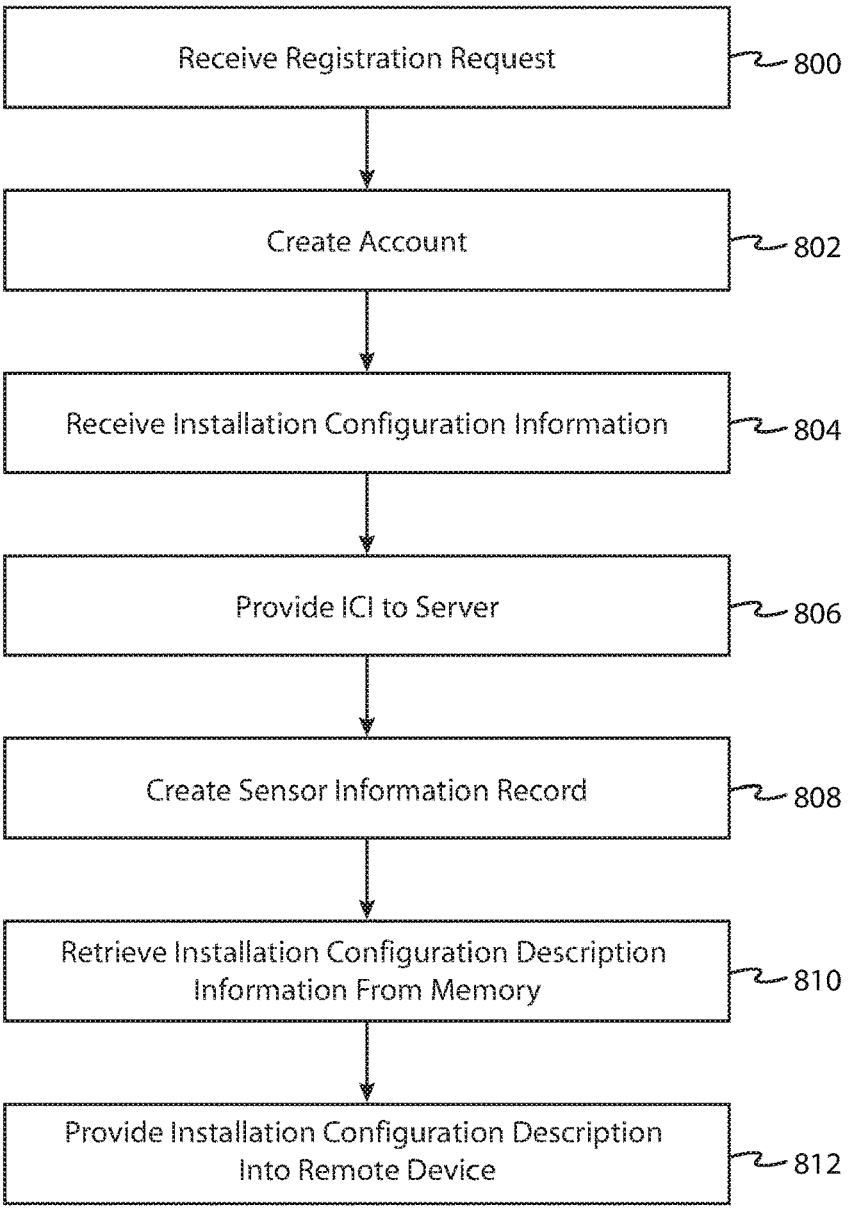
FIG. 8 is a flow diagram illustrating one embodiment for managing installation configuration information provided by the server shown in FIG. 1.

FIG. 8 is a flow diagram illustrating one embodiment for managing installation configuration information provided by one or more sensors in a security system, performed by server 108 executing processor-executable codes stored in memory. It should be understood, however, that the sensors could be used in other applications, such as industrial or home automation applications. It should be understood that in some embodiments, not all of the steps shown in FIG. 8 are performed, that the order in which the steps are carried out may be different in other embodiments, and that certain, minor steps have been omitted for brevity.

At block 800, server 108 receives a registration request from a remote device such as a mobile phone, desktop or tablet computer to register with server 108 in order to access security and/or home automation services from server 108. Registration may occur via a website provided by server 108 or an app that has been downloaded to the remote device. The registration request is provided to processor 200 via network interface 204.

At block 802, in response to receiving the registration request, processor 200 creates an account for a user of the remote device and stores the account in memory 202.

At block 804, gateway 104 receives installation configuration information from a sensor 101 located within wireless communication range of server 108. The installation configuration information is transmitted by sensor 101 as described in FIG. 7 and its accompanying description above.

At block 806, gateway 104 provides the installation configuration information to server 108 via wide-area network 106 and network interface 204.

At block 808, in response to receiving the installation configuration information, server 108 creates a sensor information record within memory 202, associated with sensor 101. Processor 300 stores the installation configuration information in the sensor information record associated with sensor 101.

At block 810, also in response to receiving the installation configuration information, server 108 retrieves installation configuration description information from memory in conformance with the installation configuration information received at block 800. The installation configuration description information comprises one or more of a text and/or graphical description of a door or window where sensor 101 has been installed or a text and/or graphical description of a door or window type where sensor 101 has been installed. For example, if the installation configuration information indicates that sensor 101 has been installed into a sliding patio door, the server 108 retrieves installation configuration description information associated with a sliding patio door from the memory and stores it in association with the sensor information record. The installation configuration description information in this case might comprise the words "Patio Door" and an icon of a typical sliding patio door.

In another embodiment, server 108 does not store the installation configuration description information in association with the installation configuration information. Rather, server 108 provides the installation configuration description information to the remote device upon registration or at some time after registration.

At block 812, server 108 provides the installation configuration description information to the remote device via wide area network 106, where it may be provided to a user of the remote device in a variety of ways. For example, a representation of residence 102 could be displayed to the user on the remote device, showing at least some of the sensors installed at residence 102. Any sensor that has provided installation configuration information to server 108 could be displayed as, for example, an icon representative of the type of door or window where each particular sensor is installed, in accordance with the installation configuration description information provided by server 108.

In another embodiment where users access their accounts via a website rather than an application running on the remote device, the installation configuration information may be displayed to users when they log into their accounts online.

The methods or algorithms described in connection with the embodiments disclosed herein may be embodied directly in hardware or embodied in processor-readable instructions executed by a processor. The processor-readable instructions may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components.

Accordingly, an embodiment of the invention may comprise a computer-readable media embodying code or processor-readable instructions to implement the teachings, methods, processes, algorithms, steps and/or functions disclosed herein.

While the foregoing disclosure shows illustrative embodiments of the invention, it should be noted that various changes and modifications could be made herein without departing from the scope of the invention as defined by the appended claims. The functions, steps and/or actions of the method claims in accordance with the embodiments of the invention described herein need not be performed in any particular order. Furthermore, although elements of the invention may be described or claimed in the singular, the plural is contemplated unless limitation to the singular is explicitly stated.

We claim:

1. A self-configuring sensor, comprising:

a first sub-sensor;

a second sub-sensor;

a wireless transmitter;

a memory for storing processor-executable instructions; and a processor coupled to the first sub-sensor, the second sub-sensor, the wireless transmitter and the memory for executing the processor-executable instructions that cause the sensor to:

determine, by the processor, based on signals received from both the first sub-sensor and the second sub-sensor whether the self-configuring sensor is installed on a door or a window.

2. The self-configuring sensor of claim 1, wherein the processor-executable instructions cause the self-configuring sensor to monitor the first and second sub-sensors for detecting changes in a first sub-sensor state and a second sub-sensor state, respectively.

3. The self-configuring sensor of claim 1, wherein the first sensor comprises a reed switch and the second sensor comprises a mechanical switch.

4. The self-configuring sensor of claim 1, wherein, subsequent to the processor determining whether the self-configuring sensor is installed on the door or the window, the processor-executable instructions cause the self-configuring sensor to select one of the first sub-sensor or the second sub-sensor to determine an open/closed status of the door or the window and transmit an alarm signal only if the selected sub-sensor has changed state.

5. The self-configuring sensor of claim 1, wherein the processor-executable instructions further cause the processor to determine that the self-configuring sensor is in a first installation configuration when the processor detects a state change in the first sub-sensor and that no state change has been detected in the second sub-sensor.

6. The self-configuring sensor of claim 1, wherein the processor-executable instructions further cause the processor to determine that the self-configuring sensor is in a multi-sensor configuration when the processor detects a state change in the first sub-sensor and a state change in the second sub-sensor.

7. The self-configuring sensor of claim 1, wherein the processor-executable instructions further comprise instructions that causes the self-configuring sensor to:

determine that the sensor has been powered on; and in response to determining that the sensor has been powered on, determine whether the self-configuring sensor is installed on the door or the window the installation configuration.

8. The self-configuring sensor of claim 1, wherein the processor-executable instructions further comprise instructions that causes the self-configuring sensor to transmit a signal to a central control panel indicative of the whether the self-configuring sensor is installed on the door or the window.

9. The self-configuring sensor of claim 1, wherein the memory further stores a sensor identification code, and the processor-executable instructions further comprise instructions that causes the self-configuring sensor to modify the sensor identification code after the processor determines whether the self-configuring sensor is installed on the door or the window.

10. The self-configuring sensor of claim 9, wherein the processor-executable instructions further comprise instructions that causes the self-configuring sensor to transmit the modified sensor identification code to a central control panel after the self-configuring sensor has determined whether the self-configuring sensor is installed on the door or the window.

11. A method, performed by a self-configuring sensor having a first sub-sensor, a second sub-sensor, and a processor in communication with the first sub-sensor and the second sub-sensor, comprising:

determining, by the processor, based on signals received from both the first sub-sensor and the second sub-sensor whether the self-configuring sensor is installed on a door or a window.

12. The method of claim 11, further comprising monitoring, by the processor, the first and second sub-sensors for detecting changes in a first sub-sensor state and a second sub-sensor state, respectively.

13. The method of claim 11, wherein the first sensor comprises a reed switch and the second sensor comprises a mechanical switch.

14. The method of claim 11, further comprising, subsequent to the processor determining whether the self-configuring sensor is installed on the door or the window, selecting, by the processor, either the first sub-sensor or the second sub-sensor to determine an open/closed status of the door or window and transmitting, by a transmitter coupled to the processor, an alarm signal only if the selected sub-sensor changes state.

15. The method of claim 11, further comprising determining, by the processor, that the self-configuring sensor is in a single sensor configuration when the processor detects a state change in the first sub-sensor and that no state change was detected in the second sub-sensor.

16. The method of claim 11, further comprising determining, by the processor, that the self-configuring sensor is in a multi-sensor configuration when the processor detects a state change in the first sub-sensor and a state change in the second sub-sensor.

17. The method of claim 11, further comprising determining, by the processor, that the self-configuring sensor has been powered on and, in response to determining that the self-configuring sensor has been powered on, determining by the processor whether the self-configuring sensor is installed on the door or the window.

18. The method of claim 11, further comprising transmitting, by a transmitter coupled to the processor, a signal to a central control panel indicative of whether the self-configuring sensor is installed on the door or the window.

19. The method of claim 11, further comprising storing a sensor identification code in a memory coupled to the processor and modifying the sensor identification code after the processor determines whether the self-configuring sensor is installed on the door or the window.

20. The method of claim 19, further comprising transmitting, by a transmitter coupled to the processor, the modified sensor identification code to a central control panel after the processor has determined whether the self-configuring sensor is installed on the door or the window.

* * * * *